United States Patent [19]

Maggio

[11] Patent Number: 4,900,022

[45] Date of Patent: Feb. 13, 1990

[54] TABLETOP BALL GAME AND EQUIPMENT

[76] Inventor: Carlo Maggio, Rossweidweg 4, 3052 Zollikofen/Bern, Switzerland

[21] Appl. No.: 86,682

[22] Filed: Aug. 18, 1987

[51] Int. Cl.[4] ..... A63B 39/00

[52] U.S. Cl. ..... 273/30; 273/76

[58] Field of Search ..... 273/30, 67 DA, 67 DB, 273/67 DC, 67 R, 73 R, 76, 73 C, 330, 320

[56] References Cited

U.S. PATENT DOCUMENTS

| | | | |
|---|---|---|---|
| 1,276,015 | 8/1918 | Belknap | 273/30 |
| 2,163,456 | 6/1939 | Youngberge | 273/30 |
| 3,148,883 | 9/1964 | Ruderian | 273/330 |
| 3,622,156 | 11/1971 | Pugsley | 273/30 |
| 3,655,187 | 4/1972 | Pugsley | 273/30 |
| 3,717,343 | 2/1973 | Hartford | 273/30 |
| 3,721,441 | 3/1973 | Wininger | 273/330 |
| 3,738,653 | 6/1973 | Simpson | 273/30 |
| 3,819,182 | 6/1974 | Lersch | 273/95 R |
| 4,368,890 | 1/1983 | Horstman et al. | 273/76 |
| 4,714,246 | 12/1987 | Parisien | 272/93 |

FOREIGN PATENT DOCUMENTS

| | | | |
|---|---|---|---|
| 0138960 | 9/1958 | Fed. Rep. of Germany | 273/30 |
| 3519745 | 12/1986 | Fed. Rep. of Germany | 273/30 |
| 2504808 | 11/1982 | France | 273/30 |
| 693170 | 8/1965 | Italy | 273/30 |

OTHER PUBLICATIONS

Wick Dry, p. 20, 1976.

*Primary Examiner*—T. Brown

*Attorney, Agent, or Firm*—Warren L. Franz

[57] ABSTRACT

A tabletop ball game has two-handled paddles for projecting a soft foam ball back and forth from end-to-end of a rectangular ballfield over a central ball bounce-deadening zone. The paddles each have a flat, round ball striking portion and two handles extending radially therefrom in coplanar fashion from diametrically opposed positions. Embodiments of the ballfield are described in the form of a top of a folding table, a rollable tabletop overlay, and a rigid conversion top for a pool table. Embodiments of the bounce-deadening zone take the form of a rectangular foam pad, a strip of carpeting, and a net horizontally hung across a gap.

3 Claims, 2 Drawing Sheets

TABLETOP BALL GAME AND EQUIPMENT

This invention relates to a tabletop ball game employing a two-handled paddle for projecting a ball across a ballfield having two playing surfaces separated by a central ball bounce-deadening zone, and equipment usable in connection therewith.

BACKGROUND OF THE INVENTION

Tabletop ball games, like ping-pong or table tennis, are well known. Such games utilize a rectangular tabletop ballfield, divided into two player ends by a vertical net suspended from posts, widthwise across the center of the tabletop. The outer bound of the ballfield are typically marked by sidelines and baselines which extend about its periphery. A center line running lengthwise down the middle of the field divides each end in half for serving purposes.

A high-bouncing, hollow plastic ball is projected from one end of the tabletop to the other by means of paddles or rackets held in one hand by each player. Each paddle has a flat, round, two-faced ball striking portion or blade that extends in coplanar fashion from a single tubular handle or grip. The paddle is used to stroke the ball either in forehand or backhand manner, utilizing one or the other of the striking portion faces. One or both paddle faces may have a vinyl, rubber or other blade covering, and may include texturing (typically "pips") and cushioning (e.g. sponge-rubber backing) for greater ball control.

In conventional ping-pong play, a player stands at each end of the ballfield. The ball is served by one player hitting it with his paddle so that it bounces first on his side of the net and then on the other side. The ball must cross over the net which presents an obstruction to play. Following the serve, play continues with each player hitting the ball over the net to the other player's side. Points are lost when a player fails to serve the ball over the net after service, fails to hit the opponent's ball before it bounces more than once on his side, or hits the ball so that it lands outside the gamefield boundary lines. Each error scores one point for the other side, with game continuing until one player scores a winning number of points.

Regulation ping-pong tabletops are quite large, requiring considerable space. Standard ping-pong balls bounce quite vigorously, thereby extending the effective playing area. The game is quite fast, with the single-handled paddle moving from one position to another, for the full reach of the player's hand that holds it.

So that the game can be played in a more confined area, modified forms of ping-pong exist that utilize smaller playing surfaces, thickly padded paddles and soft foam balls. Such equipment slows down the game, reduces the required playing area and makes it more adaptable to small home use. Ping-pong tabletops come as integral parts of portable, folding tables and as overlay conversion tops to fit over standard or pool tables.

Variations of ping-pong type ball games are given in U.S. Pat. Nos. 3,622,156; 3,655,187; and 3,189,182. The '156 patent describes a netless game wherein a ball is bounced back and forth between two coplanar playing surfaces over an intervening open space. The '187 patent describes a game in which the ball is bounced between two such surfaces through an opening in a vertical barrier. The '182 patent discloses a table game in which a soft rubber or foam ball is projected between two end areas across a central "fault" zone bounded by two elevated, widthwise extending horizontal rods. All such variations contemplate the use of standard single-handled paddles, or the like.

SUMMARY OF THE INVENTION

The present invention provides a tabletop ball game employing a two-handled paddle and in which the ball is projected from end-to-end over a horizontally disposed, central ball bounce-deadening zone. The invention further provides a two-handled paddle and a ballfield usable for said ball game, but also usable elsewhere.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENTS

Figure 1:
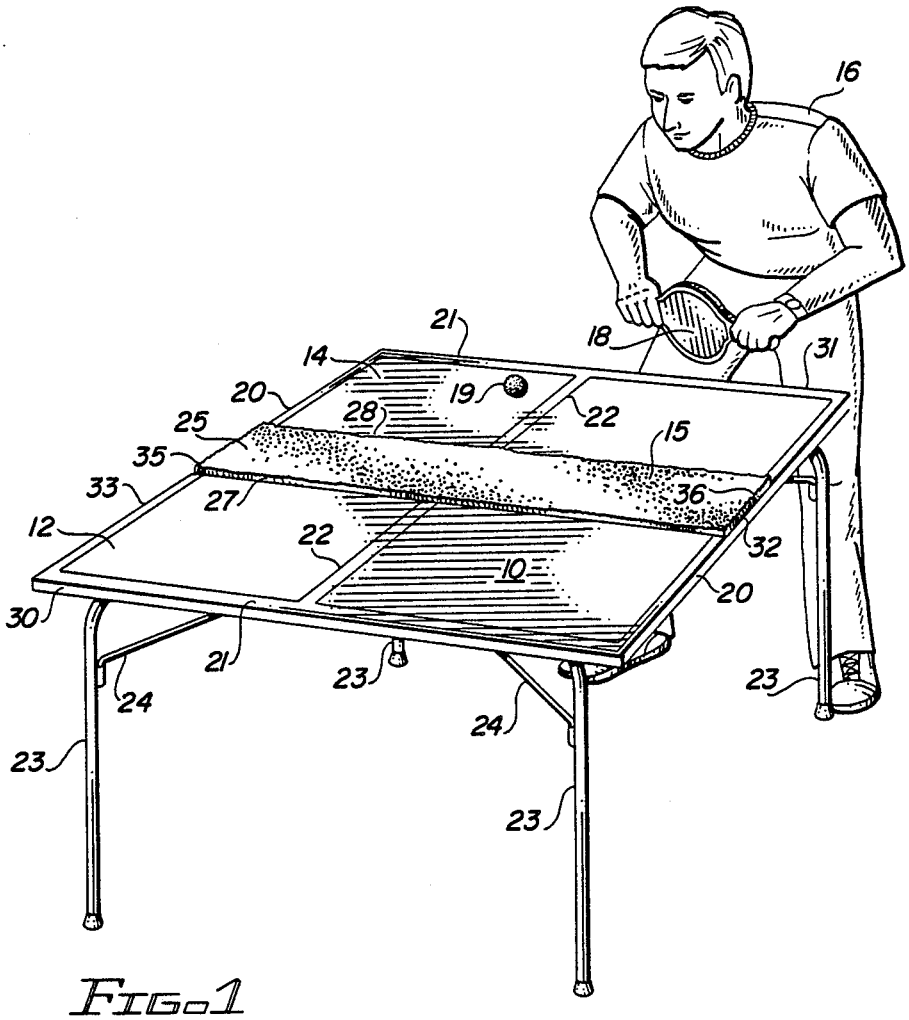
FIG. 1 is a perspective view of a paddle and table game in accordance with the present invention.

As shown in FIG. 1, the ball game according to the present invention utilizes a rectangular tabletop ballfield 10 having two horizontal, coplanar end playing surfaces or zones 12, 14 separated by a horizontal, central ball bounce-deadening zone 15. A player 16 stationed adjacent end 14 utilizes a two-handled paddle 18 to stroke a soft foam ball 19 over the bounce-deadening zone 15 to the end 12 of an opponent player (not shown). The peripheral boundaries of the playing field 10 are marked by sidelines 20 and baselines 21, and a center line 22 runs lengthwise down the middle of each end zone 12, 14 to divide the zones in half for serving purposes.

The ballfield tabletop 10 of FIG. 1 takes the form of a rectangular top of a small portable, folding table supported in its shown open position by legs 23, each of which can be brought up against the underside of tabletop 10 for storage purposes by a conventional leg folding mechanism 24 attached to each leg. The illustrated tabletop 10 may be wood, metal or plastic; the legs and folding mechanisms are preferably metal. The tabletop 10 can be optionally hinged at its center to enable it to be folded in half lengthwise.

The bounce-deadening zone 15 in the embodiment of FIG. 1 is constituted by a divider in the form of a removable rectangular, plastic-covered soft foam pad 25 which deforms when struck to spoil or "kill" the bounce of the ball 19, thereby signaling a fault. The long sides 27, 28 of the pad 25 extend parallel to the short sides 30, 31 of the tabletop 10, across the full width between the long sides 32, 33 of the tabletop 10. The short sides 35, 36 of the pad 25 extend a distance of approximately one-quarter of the length of the sides 32, 33 of the tabletop 10.

Figure 2:
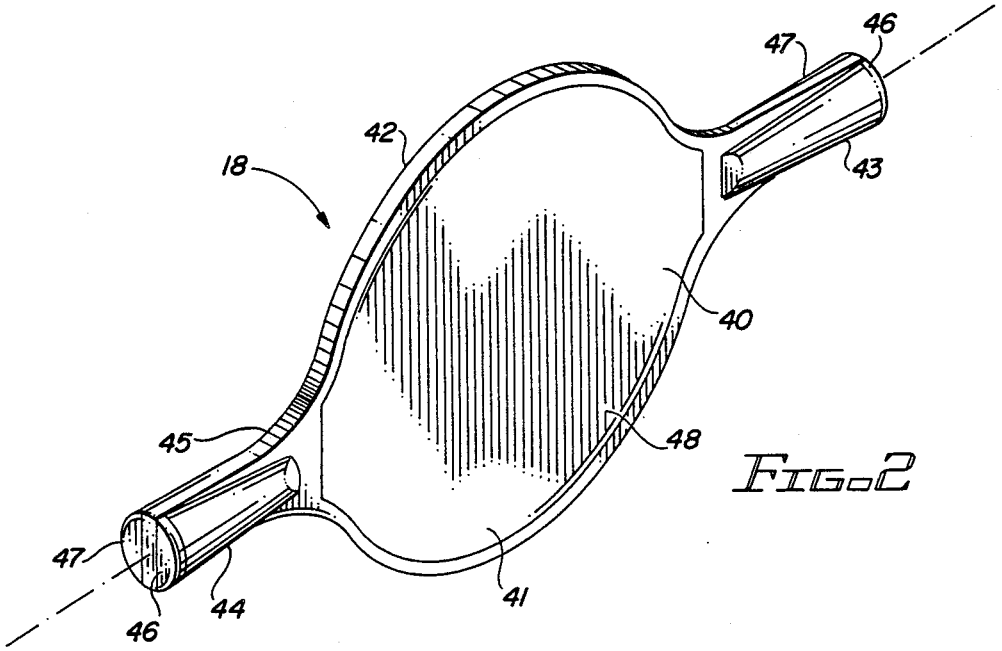
FIG. 2 is an enlarged view of the paddle of FIG. 1.

The construction of the two-handled paddle 18 in accordance with the invention is illustrated in FIG. 2.

Similar to conventional ping-pong paddles, the paddle 18 has a flat, round ball striking portion 40 having front and back ball striking faces 41, 42 on opposite sides thereof. However, unlike conventional paddles, the paddle 18 has two elongated handles or grips 43, 44 extending outwardly from positions oppositely disposed peripherally of the ball striking portion 40. In the embodiment shown, the handles 43, 44 having major axes that extend radially in coplanar fashion from diametrically opposed positions of the ball striking portion 40. It will be appreciated, though, that the positions of the handles 43, 44 may be varied somewhat from the shown positions, while still realizing the benefits of the invention.

The illustrated paddle 18 is of laminar construction made up of a flat plywood base 45 to the opposite faces of handle-position projecting portions of which are superposed rounded, plywood grip-forming sections 46, 47, as shown. The edges of the base 45 are rounded and smoothed, and the grip sections 46, 47 are tapered, or otherwise contoured, for user gripping comfort and sightly appearance. The ball striking faces 41, 42 may be suitably coated with a vinyl plastic or other covering 48 and optionally textured or cushioned, as desired. Other suitable materials for construction of the paddle 18 include styrene or other plastic and composition materials. The grips 43, 44 may be optionally wrapped with cloth or vinyl.

Figure 3:
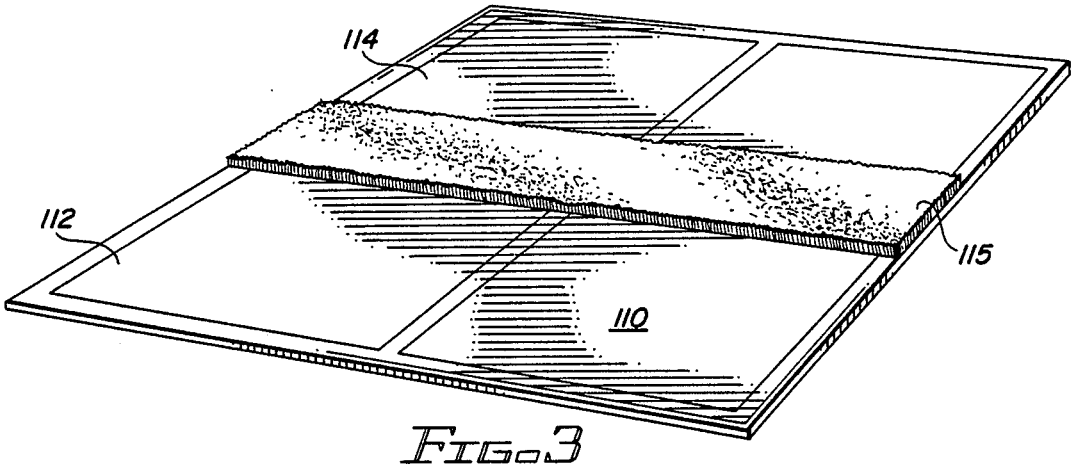
FIG. 3 is a view of a rollable version of the ballfield of FIG. 1.
Figure 4:
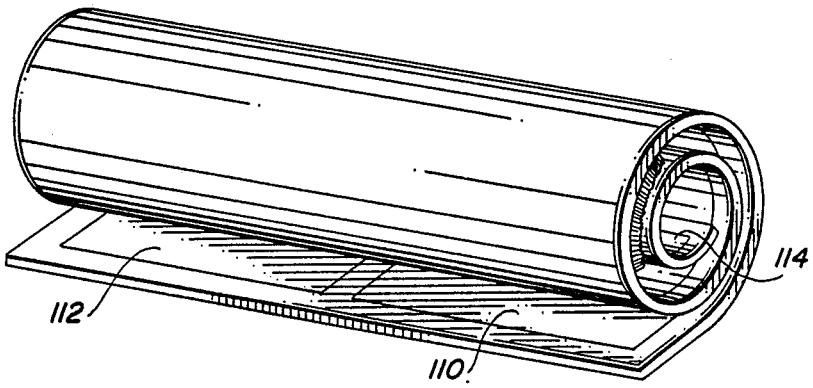
FIG. 4 is a view of the ballfield of FIG. 3, showing it in its rolled-up configuration.
Figure 5:
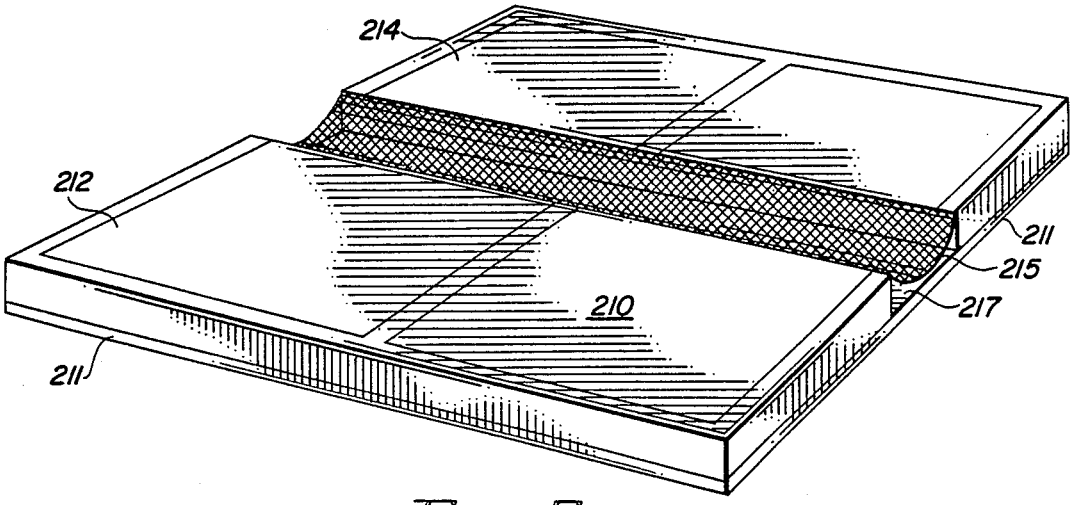
FIG. 5 is a view of a conversion tabletop version of the ballfield of FIG. 1.

Alternative versions of the tabletop ballfield are shown in FIGS. 3–5.

FIGS. 3 and 4 illustrate a ballfield 110 in the form of a rollable overlay for spreading out over the top of a conventional dining room table, or similar available supporting structure. End playing surfaces 112, 114 are formed from a fabric, plastic or other material that is thin and smooth enough so that a ball 19 (FIG. 1) landing thereon will bounce, relatively unhindered, on the covered underlying structure. The function of the central bounce-deadening zone 15 (FIG. 1) is performed in the embodiment of FIGS. 3 and 4 by an intermediate strip 115 of bounce-deadening material fastened to the ends 112, 114 so that the whole ballfield 110 presents a unitary structure that may be rolled upon itself for storage, as shown in FIG. 4. The strip 115 may suitably be made from a rectangular piece of AstroturfTM or similar synthetic carpeting material.

FIG. 5 illustrates a ballfield 210 in the form of a rigid conversion top that fits over a pool table, or the like. The ballfield 210 has a rectangular substrate 211, to the top of which is mounted at each end in aligned position a thick end playing surface forming portion 212, 214. A net 215, loosely hung horizontally across a gap 217 that separates the opposing edges of the portions 212, 214, acts as a central ball bounce-deadening zone or trap to capture the ball 19 and halt the play.

The dimensions of the ballfield, zones, paddle and ball for the various embodiments described are established according to the table game setup wished to be achieved. Exemplary dimensions (in centimeters) are as follows:

| | |
|---|---|
| Ballfield: | 130 cm length × 100 cm width |
| End Zones: | 100 cm length × 50 cm width |
| Kill Zone: | 100 cm length × 30 cm width |
| Paddle: | 37 cm total length w/handles |
| | 10 cm handle length |
| | 16 cm central diameter |

-continued

| | |
|---|---|
| Ball: | 4 cm diameter |

The listed dimensions contemplate a playing surface height of 75 cm above the floor. For a ball bounce-deadening or "kill" zone constituted by a soft foam pad 25, as in FIG. 1, a 1 cm to 2 cm thickness is suitable.

To play the tabletop game of the invention with the equipment thus described, a player 16 must hold the paddle 18 with both hands, as shown in FIG. 1. Only on a serve can the paddle 18 be held with one hand. If at any other time, the paddle 18 is held with just one hand, one point is forfeited. The play otherwise proceeds similarly as in ping-pong with minor variations and with the horizontal ball bounce-deadening zone 15, 115 or 215 acting as an obstacle to the ball 19, instead of a vertical net as in ping-pong. Points are lost when a player fails to serve the ball over the zone 15 after two tries, hits the ball so it lands in the zone 15, volleys the ball on his side of the zone 15, or hits the ball so it lands beyond the ballfield boundaries. The game continues until one player has a winning number of points. In one embodiment of the tabletop game, each player serves until five points have been scored. A player who has 15 points and is at least 2 points ahead of his opponent wins a set. If the score is 15 to 15, the game continues until one of the players reaches 20 points. The player who wins three sets wins the match.

The foregoing description thus demonstrates that the invention provides a novel tabletop ball game resembling, but playable on a much smaller scale than, ping-pong. A two-handled paddle, required to be gripped by both hands during play, restricts the scope of movement and flailing about of the paddle, as compared to conventional one-handled paddles. A reduced-size ballfield utilizes a horizontal ball bounce-deadening zone in place of the traditional vertical net to separate the two player ends and provide an obstacle to play.

It will be appreciated that the foam pad used for the bounce-deadening zone 15 in the table ballfield embodiment 10 of FIG. 1 can be replaced by a strip of material such as that described for the strip 115 of the ballfield embodiment 110 shown in FIGS. 2 and 3, or by a horizontally strung net such as the net 215 described in connection with the embodiment 210 of FIG. 5; and that similar substitutions can be made in the other embodiments. The table and conversion top structures of FIGS. 1 and 5 can also be furnished with appropriate hinging so that one end zone can be tilted up relative to the other into a 90-degree playback position for warm-up or solo practice. Although the two-handled paddle and ballfield aspects of the invention have been described together and in connection with the game aspect of the invention, it is noted that both the two-handled racket and the ballfield have separate utility. The two-handled paddle can be used in other tabletop ball games, and other (viz. single-handled) paddles can be used with the inventive ballfield.

Those skilled in the technology to which the invention relates will recognize that various other substitutions and modifications may be made to the game, equipment and rules of play detailed above, without departing from the spirit and scope of the invention as defined by the claims that follow.

What is claimed is:

1. In a tabletop ball game in which a ball is stroked back and forth between first and second horizontal, coplanar, end zone ball playing surfaces of a rectangular tabletop ballfield across a laterally extending central ballfield partitioning element by opposing players respectively stationed adjacent said end zone surfaces, each using a hand-held paddle having a flat, rounded ball striking portion and a first elongated handle having a major axis extending radially outward from said ball striking portion, the improvement comprising a table tennis-like ball game in which:

said rectangular ballfield is smaller in scale than a standard table tennis tabletop ballfield;

said central ballfield partitioning element is a horizontally disposed rectangular ball bounce-deadening element of soft material which deforms when struck to spoil the bounce of the ball; and each of said paddles further comprises a second elongated handle having a major axis extending radially outward from said ball striking position at a diametrically opposite position to said first handle, each said paddle to be gripped one handle in each hand by said players for stroking said ball across said horizontally disposed ball bounce-deadening element.

2. An improvement as in claim 1, further comprising said ball being a soft foam ball.

3. An improvement as in claim 2, wherein said ball bounce-deadening element further comprises a rectangular pad of soft foam material.

* * * * *